US005343187A

United States Patent [19]

Shiao

[11] Patent Number: 5,343,187

[45] Date of Patent: Aug. 30, 1994

[54] ELECTRIC CONTROL DEVICE FOR AN OUTDOOR LAMP

[76] Inventor: Hsuan-Sen Shiao, No. 15-1, Lane 369, Min-Chuan Rd., Taichung City, Taiwan

[21] Appl. No.: 85,594

[22] Filed: Jul. 1, 1993

[51] Int. Cl.[5] ..... H01C 10/10; H01C 10/42

[52] U.S. Cl. ..... 338/70; 338/73; 338/163; 338/164; 338/174; 338/200; 200/302.1

[58] Field of Search ..... 338/70, 73, 163, 164, 338/171, 172, 174, 200; 200/336, 345, 302.1, 302.2

[56] References Cited

U.S. PATENT DOCUMENTS

| | | | |
|---|---|---|---|
| 3,354,418 | 11/1967 | Casey et al. | 338/174 |
| 3,970,986 | 7/1976 | Seyler et al. | 338/171 |
| 4,081,782 | 3/1978 | Hildreth et al. | 338/200 |
| 4,439,654 | 3/1984 | Bresin et al. | 200/302.1 |
| 4,649,366 | 3/1987 | McDonald | 338/163 X |

*Primary Examiner*—Marvin M. Lateef
*Attorney, Agent, or Firm*—Hoffmann & Baron

[57] ABSTRACT

An electric control device for an outdoor lamp includes a control box having a side wall that is formed with a through hole, and a rotary-type variable resistance switch having a main switch housing that is disposed inside the control box and an externally threaded tubular sleeve that extends frontwardly from the main switch housing and through the through hole of the control box. The switch further has a rotatable switch arm which extends axially and rotatably from an interior of the main switch housing and through the tubular sleeve. A nut retains the switch on the control box and is threaded internally to engage the tubular sleeve. The nut has an outer peripheral surface which is formed with at least one annular peripheral groove. A resilient washer is provided on a rear face of the nut and is pressed by the nut to contact tightly the side wall of the control box. An O-ring is provided on the nut in each annular peripheral groove. The switch further includes a cap with a rear end that is formed with a recess. The switch arm extends into the recess and is mounted securely to the cap. The nut is confined within the recess of the cap such that each O-ring is in tight contact with an inner wall surface of the cap.

2 Claims, 2 Drawing Sheets

ELECTRIC CONTROL DEVICE FOR AN OUTDOOR LAMP

BACKGROUND OF THE INVENTION

1. Field of the Invention

The invention relates to a lamp, more particularly to an electric control device for an outdoor lamp.

2. Description of the Related Art

A typical electric control device of an outdoor lamp comprises a control box and a waterproof push-button switch that is mounted on the control box and that is operable so as to activate or deactivate the outdoor lamp. The main drawback of the conventional electric control device is that the intensity of light output of the outdoor lamp is fixed and cannot be varied when the push-button switch is operated so as to activate the outdoor lamp.

SUMMARY OF THE INVENTION

Therefore, the objective of the present invention is to provide an electric control device for an outdoor lamp, said electric control device including a waterproof rotary-type variable resistance switch that is operable so as to activate the outdoor lamp and so as to vary the intensity of light output of the latter.

Accordingly, an electric control device of the present invention is to be used with an outdoor lamp and comprises a control box, a rotary-type variable resistance switch, a nut, a resilient washer and at least one O-ring. The control box has a side wall that is formed with a through hole. The switch has a main switch housing that is disposed inside the control box and an externally threaded tubular sleeve that extends frontwardly from the main switch housing and through the through hole of the control box. The switch further has a rotatable switch arm which extends axially and rotatably from an interior of the main switch housing and through the tubular sleeve. The nut retains the switch on the control box and is threaded internally to engage the tubular sleeve. The nut has an outer peripheral surface which is formed with at least one annular peripheral groove. The washer is provided on a rear face of the nut and is pressed by the nut to contact tightly the side wall of the control box to prevent water seepage into the control box via the through hole. Each O-ring is provided in the corresponding annular peripheral groove of the nut. The switch further includes a cap with a rear end that is formed with a recess. The switch arm extends into the recess and is mounted securely to the cap. The nut is confined within the recess of the cap such that each O-ring is in tight contact with an inner wall surface of the cap to prevent water leakage into the tubular sleeve via the recess. The cap is rotated so as to rotate therewith the switch arm in order to activate the outdoor lamp and vary the intensity of light output of the outdoor lamp.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
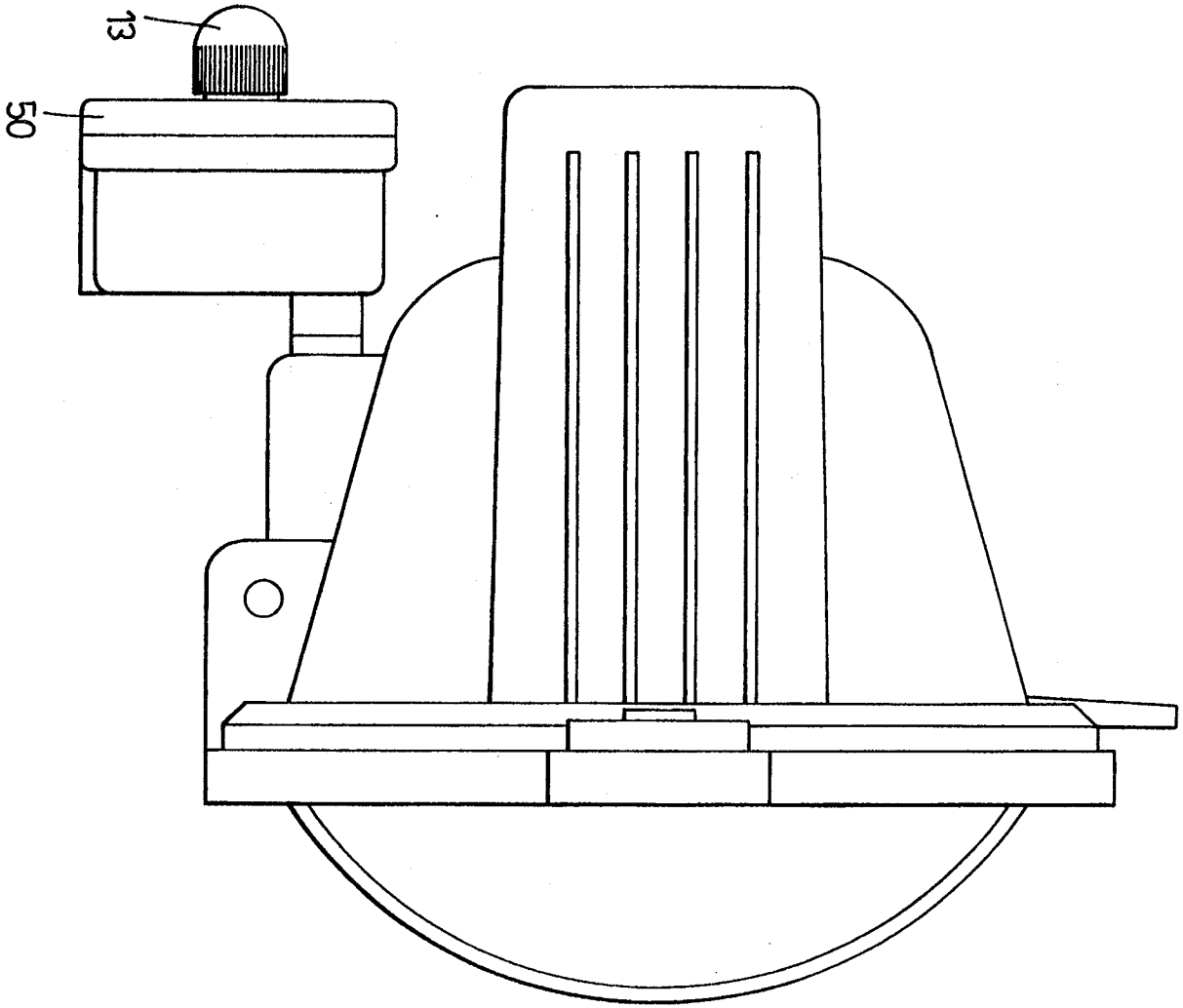
FIG. 1 is an illustration of an outdoor lamp which incorporates the electric control device of the present invention.
Figure 2:
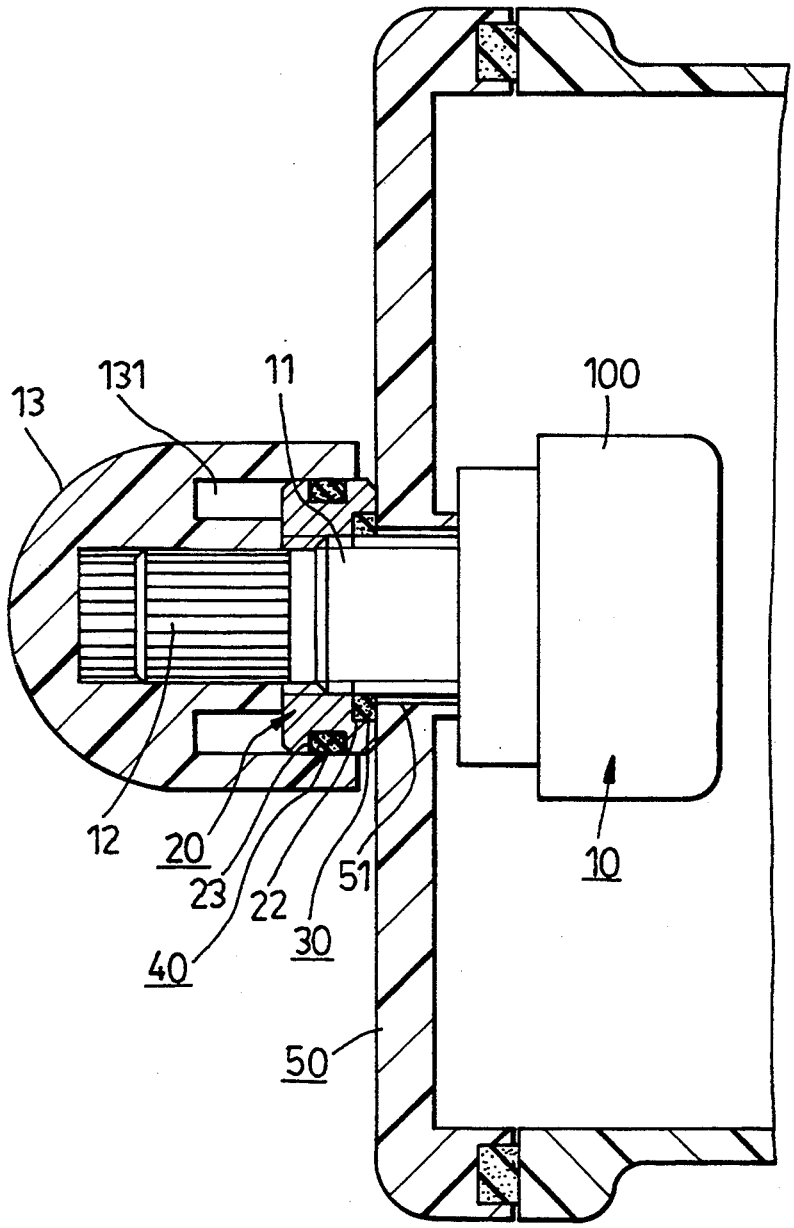
FIG. 2 is a fragmentary sectional view of the electric control device of the present invention.

Referring to FIGS. 1 and 2, the preferred embodiment of an electric control device according to the present invention is shown to comprise a rotary-type variable resistance switch (10), a nut (20), a resilient washer (30), an O-ring (40) and a control box (50).

The switch (10) includes a main switch housing (100) and an externally threaded tubular sleeve (11) which extends frontwardly from the main switch housing (100). The main switch housing (100) is disposed inside the control box (50). The control box (50) has a side wall which is formed with a through hole (51) to permit the tubular sleeve (11) to extend therethrough. The switch (10) further includes a rotatable switch arm (12) which extends axially and rotatably from an interior of the main switch housing (100) and through the tubular sleeve (11). A cap (13) has a rounded front end and a rear end that is formed with a recess (131). The switch arm (12) has a distal end that extends into the recess (131) and that is mounted securely to the cap (13). The cap (13) is rotated so as to rotate therewith the switch arm (12) in .order to activate the outdoor lamp and vary the intensity of light output of the same.

The nut (20) is threaded internally so as to engage the tubular sleeve (11) and is used to retain the switch (10) on the control box (50). The nut (20) has a rear face which is provided with an annular groove (22) around a central hole of the same. The nut (20) further has an outer peripheral surface which is formed with an annular peripheral groove (23).

The resilient washer (30) is a rubber ring with a thickness that is slightly greater than a depth of the annular groove (22). Before the nut (20) is provided on the tubular sleeve (11), the washer (30) is fitted in the annular groove (22). Thus, when the nut (20) is tightened on the tubular sleeve (11) so as to retain the switch (10) on the control box (50), the washer (30) is compressed so as to contact tightly the side wall of the control box (50) to prevent the seepage of water into the control box (50) via the through hole (51) and the gap between the rear face of the nut (20) and the control box (50).

The O-ring (40) is provided on the outer peripheral surface of the nut (20) in the annular peripheral groove (23). When the cap (13) is mounted on the distal end of the switch arm (12), the nut (20) is confined within the recess (131) of the cap (13) such that the O-ring (40) is in tight contact with the inner wall surface of the latter. The O-ring (40) prevents the leakage of water into the tubular sleeve (11) via the recess (131) and the gap between the outer peripheral surface of the nut (20) and the inner wall surface of the cap (13) when the cap (13) is rotated so as to rotate therewith the switch arm (12).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

For example, the number of resilient washers (30) and O-rings (40) installed may be increased in order to enhance the waterproofing features of the switch (10), thereby increasing correspondingly the useful life of the present invention.

I claim:

1. An electric control device for an outdoor lamp, comprising:

a control box having a side wall that is formed with a through hole;

a rotary-type variable resistance switch having a main switch housing that is disposed inside said control box and an externally threaded tubular sleeve that extends frontwardly from said main switch housing and through said through hole of said control box, said switch further having a rotatable switch arm which extends axially and rotatably from an interior of said main switch housing and through said tubular sleeve;

a nut for retaining said switch on said control box, said nut being threaded internally to engage said tubular sleeve and having an outer peripheral surface which is formed with at least one annular peripheral groove;

a resilient washer provided on a rear face of said nut and pressed by said nut to contact tightly said side wall of said control box to prevent water seepage into said control box via said through hole; and an O-ring provided on said nut in each said annular peripheral groove;

said switch further including a cap with a rear end that is formed with a recess, said switch arm extending into said recess and being mounted securely to said cap, said nut being confined within said recess of said cap such that each said O-ring is in tight contact with an inner wall surface of said cap to prevent water leakage into said tubular sleeve via said recess, said cap being rotated so as to rotate therewith said switch arm in order to activate said outdoor lamp and vary the intensity of light output of said outdoor lamp.

2. The electric control device as claimed in claim 1, wherein said rear face of said nut is formed with an annular groove to receive said washer therein, said annular groove having a depth that is slightly smaller than a thickness of said washer.

* * * * *